US007118379B1

(12) United States Patent
Wang

(10) Patent No.: US 7,118,379 B1
(45) Date of Patent: Oct. 10, 2006

(54) FEMALE CONNECTOR MEMBER FOR TOWING CONNECTOR

(76) Inventor: Jen-Ching Wang, No. 27, Alley 7, Lane 537, Da An Rd., Shu Lin Chen, Taipei County (TW)

( * ) Notice: Subject to any disclaimer, the term of this patent is extended or adjusted under 35 U.S.C. 154(b) by 148 days.

(21) Appl. No.: 10/981,580

(22) Filed: Nov. 5, 2004

(51) Int. Cl.
*H01R 33/00* (2006.01)

(52) U.S. Cl. ..... 439/35; 439/490

(58) Field of Classification Search ..... 439/35, 439/488–490

See application file for complete search history.

(56) References Cited

U.S. PATENT DOCUMENTS 5,549,478 A * 8/1996 McGuire ..... 439/35
6,027,377 A * 2/2000 Wang ..... 439/692
6,259,170 B1 * 7/2001 Limoge et al. ..... 307/10.8
6,305,945 B1 * 10/2001 Vance ..... 439/35
6,390,824 B1 * 5/2002 Vance ..... 439/35
6,695,621 B1 * 2/2004 Wang ..... 439/35
6,749,438 B1 * 6/2004 Scheller et al. ..... 439/35
6,814,581 B1 * 11/2004 Matsuo et al. ..... 439/35
2005/0037632 A1 * 2/2005 Ihde ..... 439/35
2005/0176265 A1 * 8/2005 Jacobs ..... 439/35

* cited by examiner

*Primary Examiner*—Gary F. Paumen
(74) *Attorney, Agent, or Firm*—Troxell Law Office, PLLC

(57) ABSTRACT

A female connector member for towing connector is disclosed to have a light emitting diode indicator light set installed in the locating frame thereof, keeping the light emitting diode indicator lights respectively electrically connected to the left direction light, right directional light, license light (tail light), stop light, battery charger, and back light of the towing truck and protruded over the front side of the locating frame for easy checking of the functioning of the respective signal lights and the battery charger of the towing truck.

4 Claims, 5 Drawing Sheets

FEMALE CONNECTOR MEMBER FOR TOWING CONNECTOR

BACKGROUND AND SUMMARY OF THE INVENTION

The present invention relates to a towing connector and more particularly, to a female connector member for towing connector, which has light emitting diode indicator lights installed therein and respectively connected to the signal lights and battery charger of the towing truck for easy checking of the functioning of the signal lights and battery charger of the towing truck.

FIG. 1 shows a female connector member 6 for towing connector according to the prior art. This structure of female connector member 6 has a plurality of electric wires 71~76 for connection to the left directional light, right directional light, license light (tail light), stop light, 12V battery charger, and back light of the towing truck. This design of female connector member 6 has no indicator means to help quick examination of the functioning of the respective signal lights and battery charger of the towing truck.

The present invention has been accomplished under the circumstances in view. It is therefore one object of the present invention to provide a female connector member for towing connector, which enables the towing truck driver to check the functioning of the indicator lights and battery charger of the towing truck visually conveniently. It is another object of the present invention to provide a female connector member for towing connector, which is easy to install.

According to one aspect of the present invention, the female connector member has a light emitting diode indicator light set installed in the locating frame thereof with the respective light emitting diode indicator lights respectively electrically connected to the signal lights and battery charger of the towing truck for easy checking of the functioning of the signal lights and battery charger of the towing truck. According to another aspect of the present invention, the light emitting diode indicator light set has a shell with a positioning block for quick installation in the locating frame of the body of the female connector member with less labor and installation time.

DETAILED DESCRIPTION OF THE INVENTION

Figure 1:
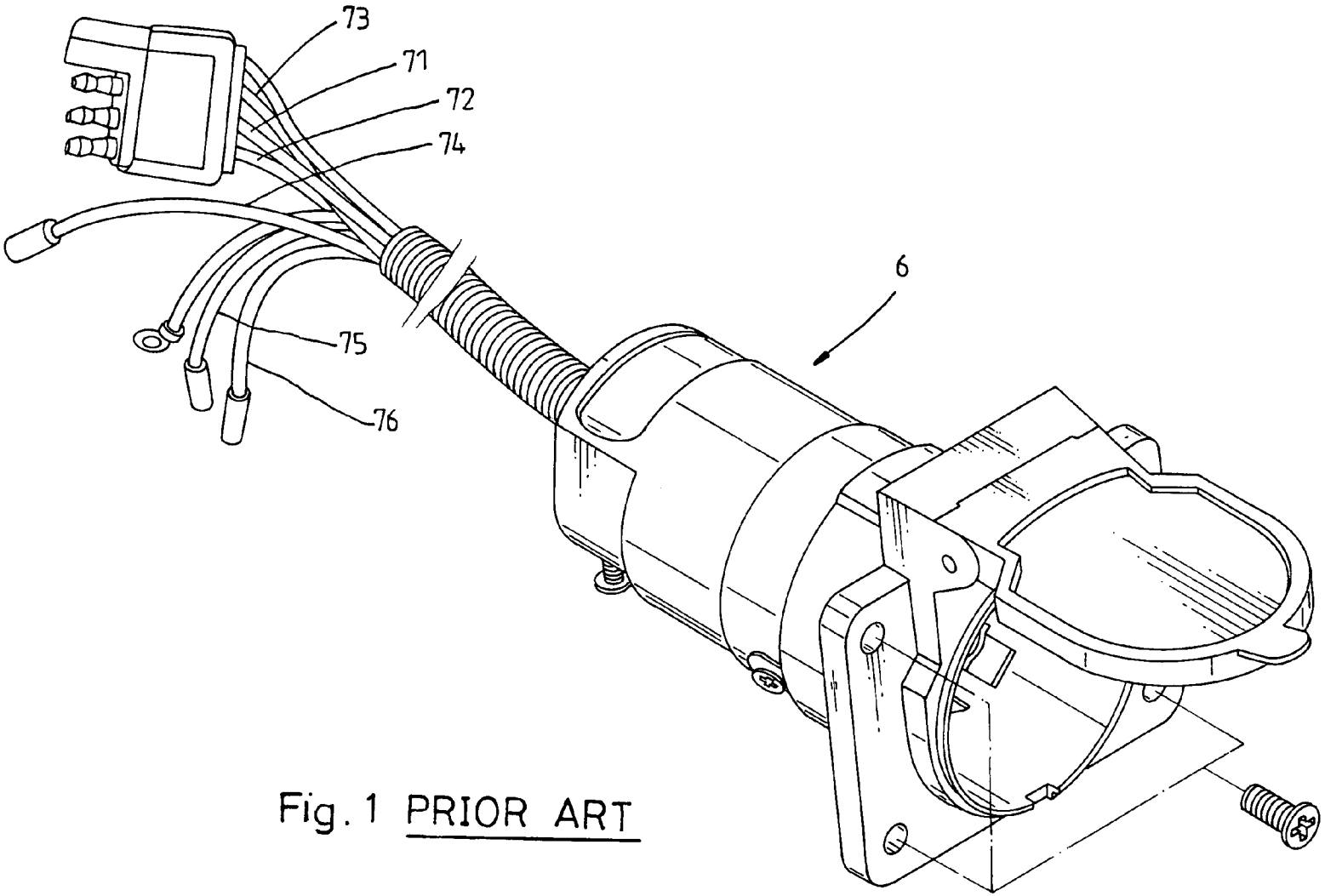
Fig. 1 PRIOR ART
FIG. 1 is a perspective view of a towing connector according to the prior art.
Figure 2:
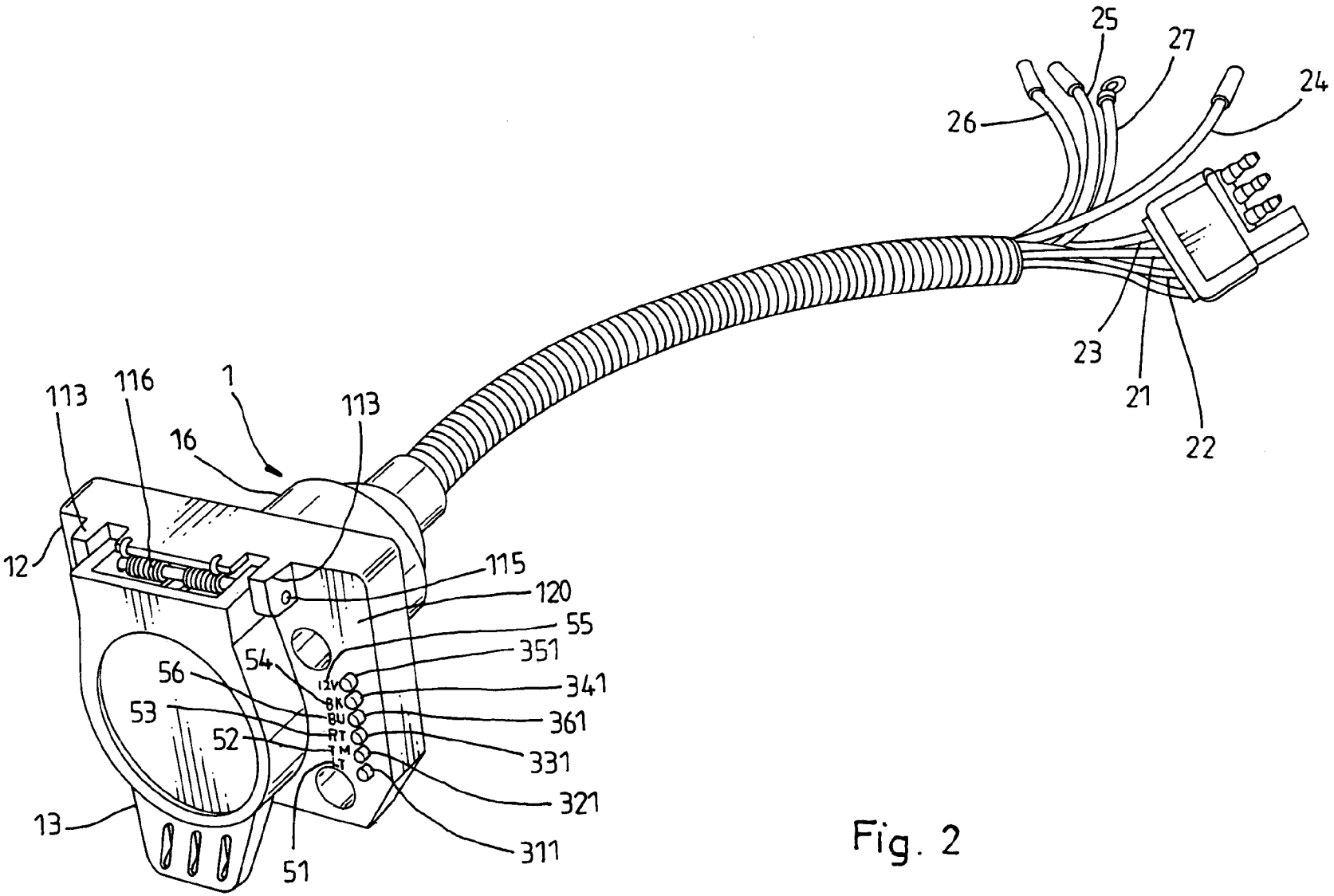
FIG. 2 is a perspective view of a female connector member for towing connector according to the present invention.
Figure 3:
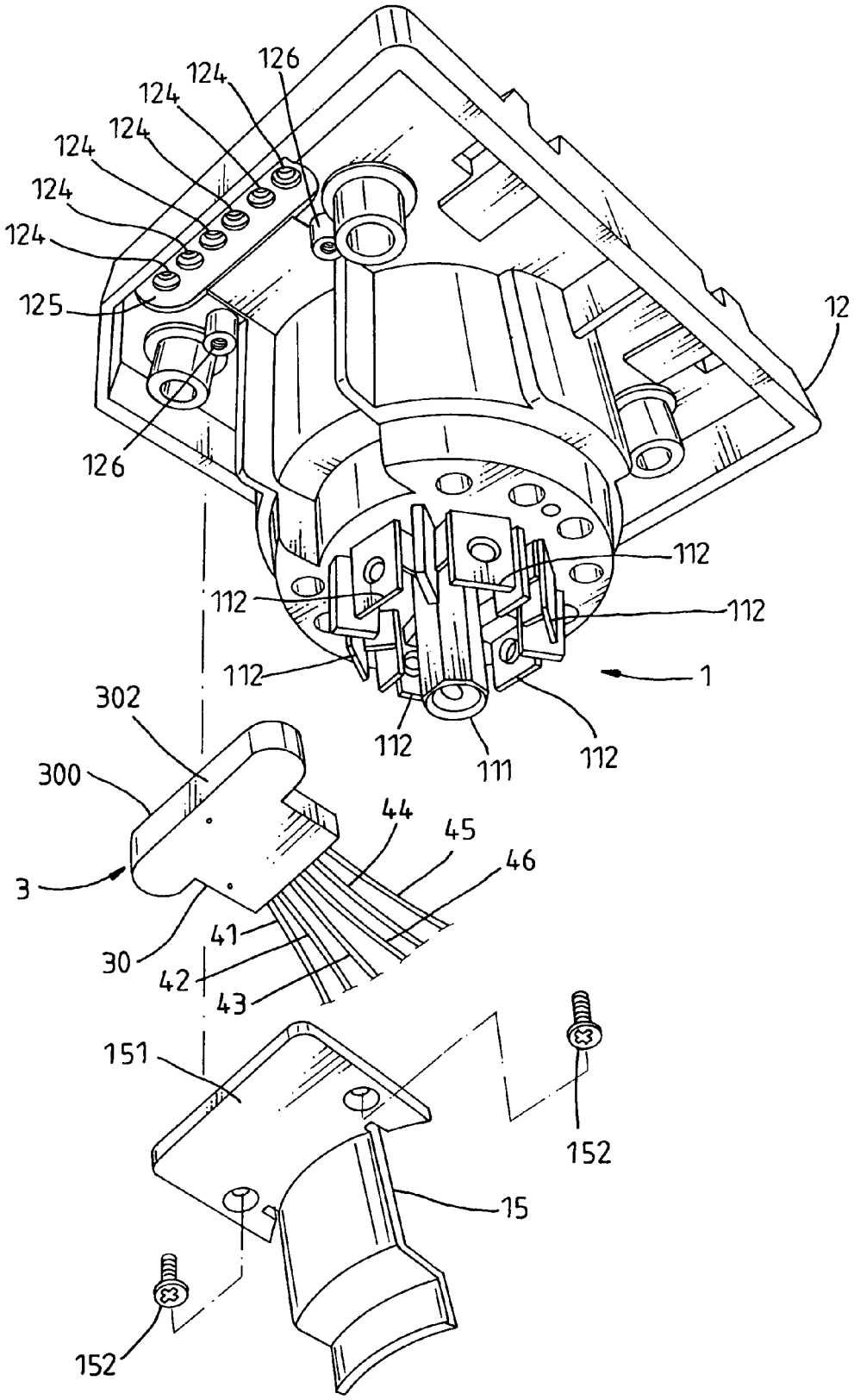
FIG. 3 is an exploded view of the female connector member for towing connector according to the present invention.
Figure 4:
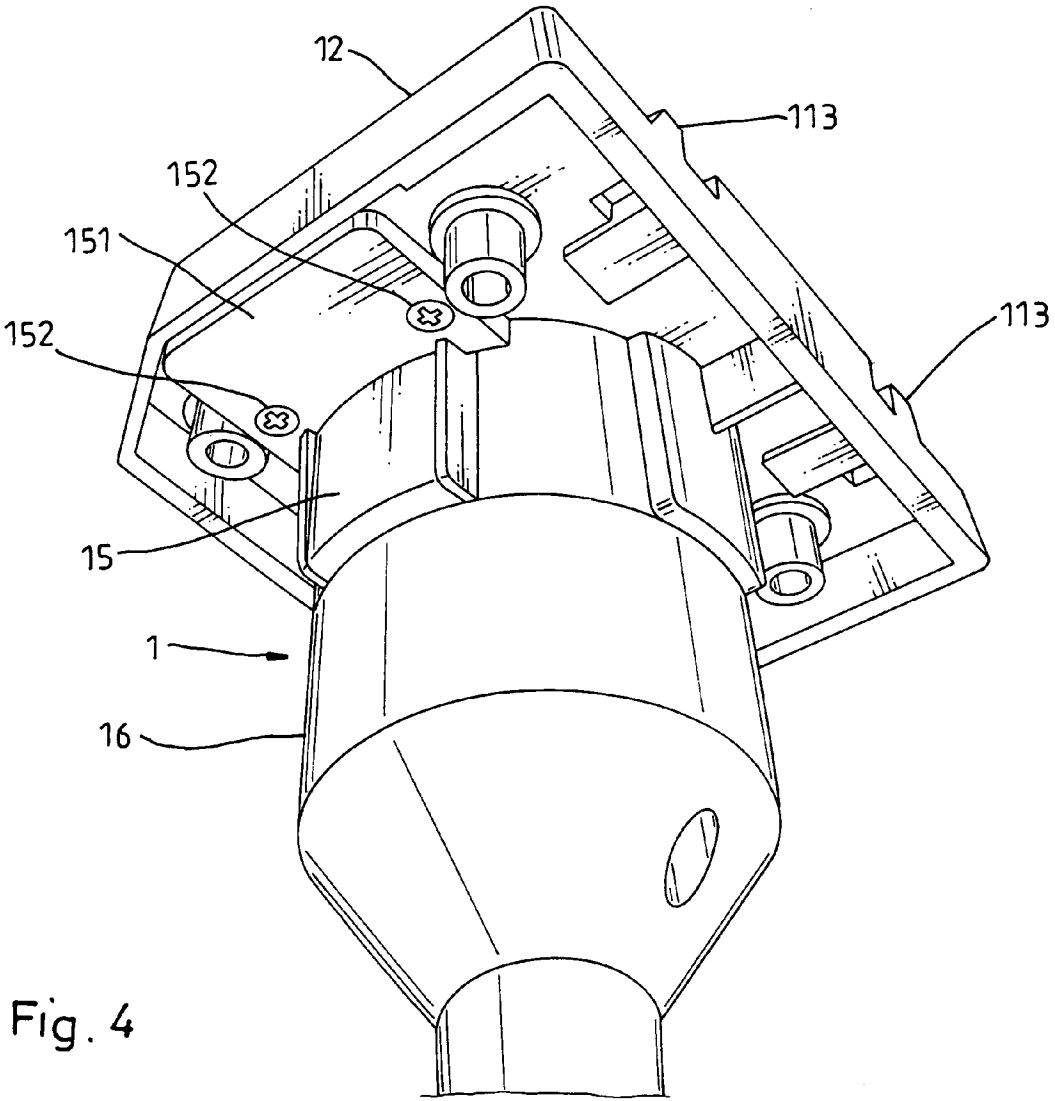
FIG. 4 is an oblique rear elevation of the female connector member for towing connector according to the present invention.
Figure 5:
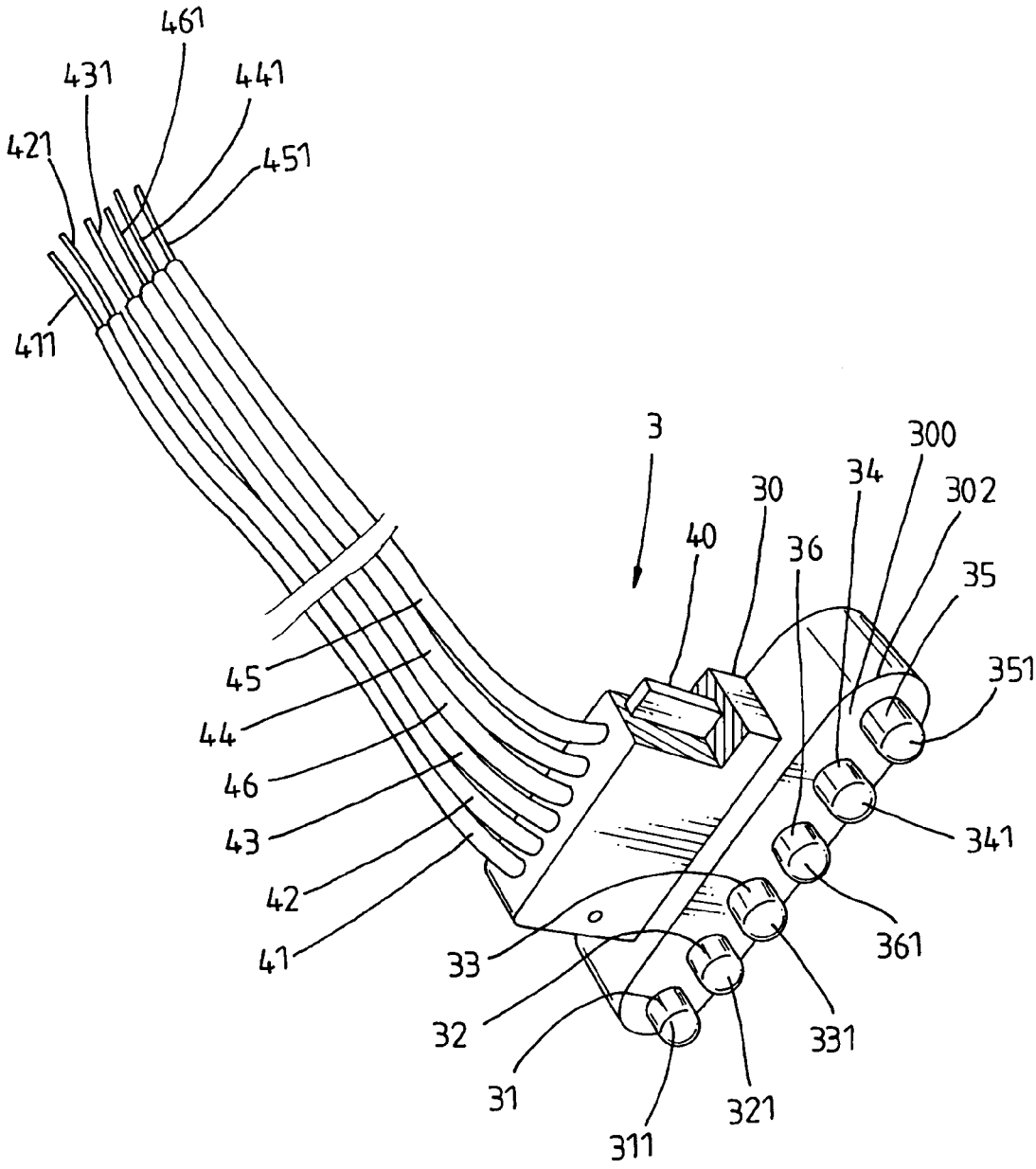
FIG. 5 is a perspective view of a part of the present invention, showing the arrangement of the light emitting diode indicator light set according to the present invention.

Referring to FIGS. 2~5, a female connector member for towing connector in accordance with the present invention is shown comprising a body 1. The body 1 comprises a locating frame 12, a front insertion hole (not shown) formed in the front side of the locating frame 12 for receiving a male connector member for towing connector, a hollow conductor shaft 111 and a plurality of conductor spring plates 112 provided at the back side of the locating frame 12, two front lugs 113 bilaterally projected from the front side of the locating frame 12 at the top, a front cover 13 pivotally connected between the front lugs 113 by a pivot 115, a torsional spring 116 mounted on the pivot shaft 115 and connected between the locating frame 12 and the front cover 13 to hold the front cover 13 closed on the front insertion hole in the locating frame 12, and a set of electric wires 21~27 arranged into a cable and inserted through the back cover 16 and respectively connected to the hollow conductor shaft 111 and the conductor spring plates 112. The electric wires 21~27 have the respective other end respectively connected in proper order to the left directional light, license light (tail light), right directional light, stop light, 12V battery charger, back light, and grounding terminal of the towing truck.

The main features of the present invention are outlined hereinafter. The locating frame 12 of the body 1 has a locating groove 125 in the back side near one lateral side, and a plurality of lamp holes 124 formed in the locating groove 125 and extended through the front and rear sides of the locating frame 12 for receiving the bulbs 311,321,331, 341,351,361 of the indicator lights 31,32,33,34,35,36 of a light emitting diode indicator light set 3. The bulbs 311,321, 331,341,351,361 of the indicator lights 31,32,33,34,35,36 protrude over the front wall 120 of the locating frame 12. The lead wires 41,42,43,44,45,46 of the indicator lights 31,32,33,34,35,36 of the light emitting diode indicator light set 3 each have the respective opposite end 411,421,431, 441,451,461 respectively electrically connected to the electric wires 21~26, namely, the electric wire for left directional light 21, the electric wire for license light (tail light) 22, the electric wire for right directional light 23, the electric wire for stop light 24, the electric wire for 12V battery charger 25, and the electric wire for back light 26. By means of the on/off status of the indicator lights 31,32,33,34,35,36 of the light emitting diode indicator light set 3, the towing truck driver can visually check the functioning status of the left directional light, license light (tail light), right directional light, stop light, 12V battery charger, and back light of the towing truck.

Further, the indicator lights 31,32,33,34,35,36 can be soldered to respective contacts at a circuit board 40, and then the lead wires 41,42,43,44,45,46 are respectively soldered to the circuit board 40, and then a shell 30 is molded on the circuit board 40 and the lead wires 41,42,43,44,45,46, keeping the bulbs 311,321,331,341,351,361 of the indicator lights 31,32,33,34,35,36 protruded over the top side 300 of the shell 30 at a distance. During installation, the shell 30 is affixed to the locating frame 12 of the body 1 with fastening devices 152.

Further, the shell 30 has a positioning block 302 fitted into the locating groove 125 in the back side of the locating frame 12 of the body 1 to hold the indicator lights 31,32, 33,34,35,36 in the lamp holes 124. Further, a side cover 15 is fastened to locating posts 126 at the back side of the locating frame 12 at one lateral side with screws 152 (see FIG. 3), having a cover panel 151 covered on the shell 30 of the light emitting diode indicator light set 3.

Further, the locating frame 12 of the body 1 has marked on the e front wall 120 marks LT 51, TM 52, RT 53, BU 56, BK 54 and 12V 55 corresponding to the indicator lights 31,32,33,34,35,36 for quick recognition.

As indicated above, the invention achieves the following advantages:

1. By means of on/off status of the indicator lights 31,32,33,34,35,36 of the light emitting diode indicator light set 3, the towing truck driver can visually check the functioning status of the left directional light, license light (tail light), right directional light, stop light, 12V battery charger, and back light of the towing truck. For example, if the light emitting diode indicator light 31 is off after turned on the left directional light switch of the towing truck, it means that the left directional light fails; if the light emitting diode indicator light 34 is off and the light emitting diode indicator light (right directional light indicator light) 33 is on after turned on the stop light switch of the towing truck, it means a wrong electric wiring, and the electric wiring must be examined immediately.

2. The light emitting diode indicator light set 3 has a shell 30 with a positioning block 302 for quick installation in the locating groove 125 of the locating frame 12 of the body 1 with less labor and installation time.

What is claimed is:

1. A female connector member for a towing connector comprising a locating frame, said locating frame having a front side and a rear side, a front insertion hole formed in the front side of said locating frame for receiving a male connector member for the towing connector, a hollow conductor shaft and a plurality of conductor spring plates provided at the back side of said locating frame, two front lugs bilaterally projected from the front side of said locating frame at the top, a front cover pivotally connected between said front lugs with a pivot shaft, a torsional spring mounted on said pivot shaft and connected between said locating frame and said front cover to hold said front cover closed on said front insertion hole, and a set of electric wires arranged into a cable and inserted through a back cover, said electric wires having a respective first end respectively connected to said hollow conductor shaft and said conductor spring plates and a respective second end for connection to a respective signal light of a towing truck;

wherein said locating frame has a plurality of lamp holes extended through the front and rear sides thereof; a light emitting diode indicator light set is installed in said locating frame, said light emitting diode indicator light set comprising a plurality of light emitting diode indicator lights respectively mounted in said lamp holes in said locating frame, and a plurality of lead wires respectively extended from said light emitting diode indicator lights and respectively electrically connected to said electric wires for connection to respective signal lights of a towing truck.

2. The female connector member for towing connector as claimed in claim 1, wherein said light emitting diode indicator light set comprising a circuit board electrically connected between said light emitting diode indicator lights and said lead wires, and a shell bonded to said circuit board and covered over the connection area between said light emitting diode indictor lights and said lead wires and fixedly fastened to said locating frame with fastening means.

3. The female connector member for towing connector as claimed in claim 1, wherein said locating frame has marks marked on the front side corresponding to said light emitting diode indicator lights for quick recognition of the respective light emitting diode indicator lights.

4. The female connector member for towing connector as claimed in claim 1, wherein said locating frame has a locating groove formed in the back side thereof; said lamp holes are formed in said locating groove and extended through the front and back sides of said locating frame; said shell of said light emitting diode indicator light set has a positioning block fitted into said locating groove in the back side of said locating frame; said back cover has a cover panel covered on said shell of said light emitting diode indicator light set.

* * * * *